United States Patent [19]

Usry

[11] 4,009,461

[45] Feb. 22, 1977

[54] EXTERNALLY ACTUATED CLAMPING SYSTEM FOR TRANSFORMER WINDINGS INCORPORATING A MECHANICAL FOLLOW-UP DEVICE

[75] Inventor: Gerald O. Usry, Rome, Ga.

[73] Assignee: General Electric Company

[22] Filed: July 24, 1975

[21] Appl. No.: 598,702

[52] U.S. Cl. ..... 336/197; 269/25

[51] Int. Cl.[2] ..... H01F 27/30

[58] Field of Search ..... 336/197; 269/25; 310/214

[56] References Cited

UNITED STATES PATENTS

| | | | |
|---|---|---|---|
| 1,961,761 | 6/1934 | Hendricks, Jr. | 336/197 |
| 3,040,280 | 6/1962 | Wiederkehr | 336/197 X |
| 3,156,885 | 11/1964 | Koza | 336/197 |
| 3,344,381 | 9/1967 | Koepke | 336/197 X |

FOREIGN PATENTS OR APPLICATIONS

| | | | |
|---|---|---|---|
| 1,162,956 | 9/1969 | United Kingdom | 336/197 |

*Primary Examiner*—Thomas J. Kozma
*Attorney, Agent, or Firm*—John J. Kelleher

[57] ABSTRACT

An improved clamping device for maintaining clamping pressure in a winding of a power transformer during its useful life. A remotely actuated hydraulic jack, or similar device, is used to initially apply a clamping force to the transformer winding. A spring-loaded mechanical follow-up device maintains the coil clamping force at a relatively fixed value when the remotely activated clamping force is relieved.

10 Claims, 5 Drawing Figures

58a
24
42
44
40a
46
58b
26
60b
2
2
60a
56a
56b
38
30
28
36
54
52b
20
22
50
52a
34
32
48
33

EXTERNALLY ACTUATED CLAMPING SYSTEM FOR TRANSFORMER WINDINGS INCORPORATING A MECHANICAL FOLLOW-UP DEVICE

BACKGROUND OF THE INVENTION

The present invention relates to power transformer coil-clamping apparatus and particularly to remotely actuated coil-clamping apparatus having a spring-loaded mechanical follow-up device for maintaining the coil clamping force at a predetermined value once the force generated by the coil-clamping apparatus drops below a predetermined value.

It is fairly well known by those skilled in the transformer art that unrestrained transformer windings expand axially when subjected to substantial overload or short-circuit currents. Under such heavy stress conditions, transformer windings telescope with respect to each other. In order to restrain such axial movement, the ends of such windings must be held in a relatively fixed position with respect to each other in order to prevent winding damage and eventual transformer failure.

In order to keep a transformer winding as tight as possible, it is generally preferable to compress the transformer winding to the greatest degree practicable during transformer manufacture. The limits placed upon the amount of compressive force that can be safely used is dependent upon the strength of the winding components as well as the strength of its supporting structure. For example, if winding insulation is overstressed mechanically by excessive compressive force, insulation breakdown and winding failure may result.

At the present time transformer windings are clamped in the factory by a variety of mechanical devices. These devices eventually form a part of a completed transformer. Winding compressing techniques used according to the prior art, have disadvantages which may be detrimental to transformer operation. During normal operation and heat cycling of the transformer winding structure, the amount of compressive force within the winding structure increases and decreases due to winding thermal expansion characteristics. After a sufficient length of time, this cycling results in winding components acquiring a new permanent dimension or set which is normally smaller than the winding dimension at the time of original construction and clamping. After the transformer has been in operation for a period of time, the winding structure tends to loosen with respect to its supporting structure. This just-mentioned loosening reduces the ability of the winding, with its supporting structure, to withstand axial forces resulting from short-circuit or other high current conditions because a loosely mounted transformer winding has the ability to acquire sufficient winding damaging momentum.

One limitation on many of the present clamping systems is that any further clamping of a transformer winding, which has loosened subsequent to completion of manufacture, cannot readily be accomplished without transferring such a transformer to a service shop. Once in a service shop, the previously sealed transformer tank must be opened for access to the mechanism that controls the transformer winding clamping device. Several methods have been suggested in the past to avoid the movement and unsealing of such transformers. These ideas consist mainly of jack screws and other mechanical devices reachable through removable access ports after the transformer is deenergized. Another clamping system is described by G. O. Usry et al. in the IEEE Transactions on Power Apparatus and Systems, July/Aug., Vol. PAS-93 No. 4, at page 1047. In this system a hydraulic clamping system, actuated externally of a transformer enclosure, provides a relatively simple means for adjusting the amount of winding clamping force desired while such a transformer is located in the field. However, a system that hydraulically clamps a transformer winding for an extended period of time has at least one serious shortcoming. Hydraulic pressure associated with a hydraulic clamping device will eventually leak past hydraulic sealing means associated with such a device causing transformer winding clamping force to dissipate.

Other clamping devices for transformer windings that, for some reason or other lose their clamping ability over an extended period of time, place a transformer winding in an equally vulnerable condition, which is that of a transformer winding highly susceptible to permanent damage if subjected to heavy overload currents while in an unclamped state.

SUMMARY OF THE INVENTION

In accordance with the present invention a transformer winding clamping arrangement, actuated from a position external of a transformer, has incorporated therein a device for maintaining a clamping force on said transformer winding. Once the transformer winding clamping force drops below a predetermined value, an externally actuated hydraulic jacking device returns the winding clamping force to a predetermined value, said hydraulically generated clamping force being maintained by a mechanical follow-up device.

BREIF DESCRIPTION OF THE DRAWINGS

DESCRIPTION OF THE PREFERRED EMBODIMENTS

Figure 1:
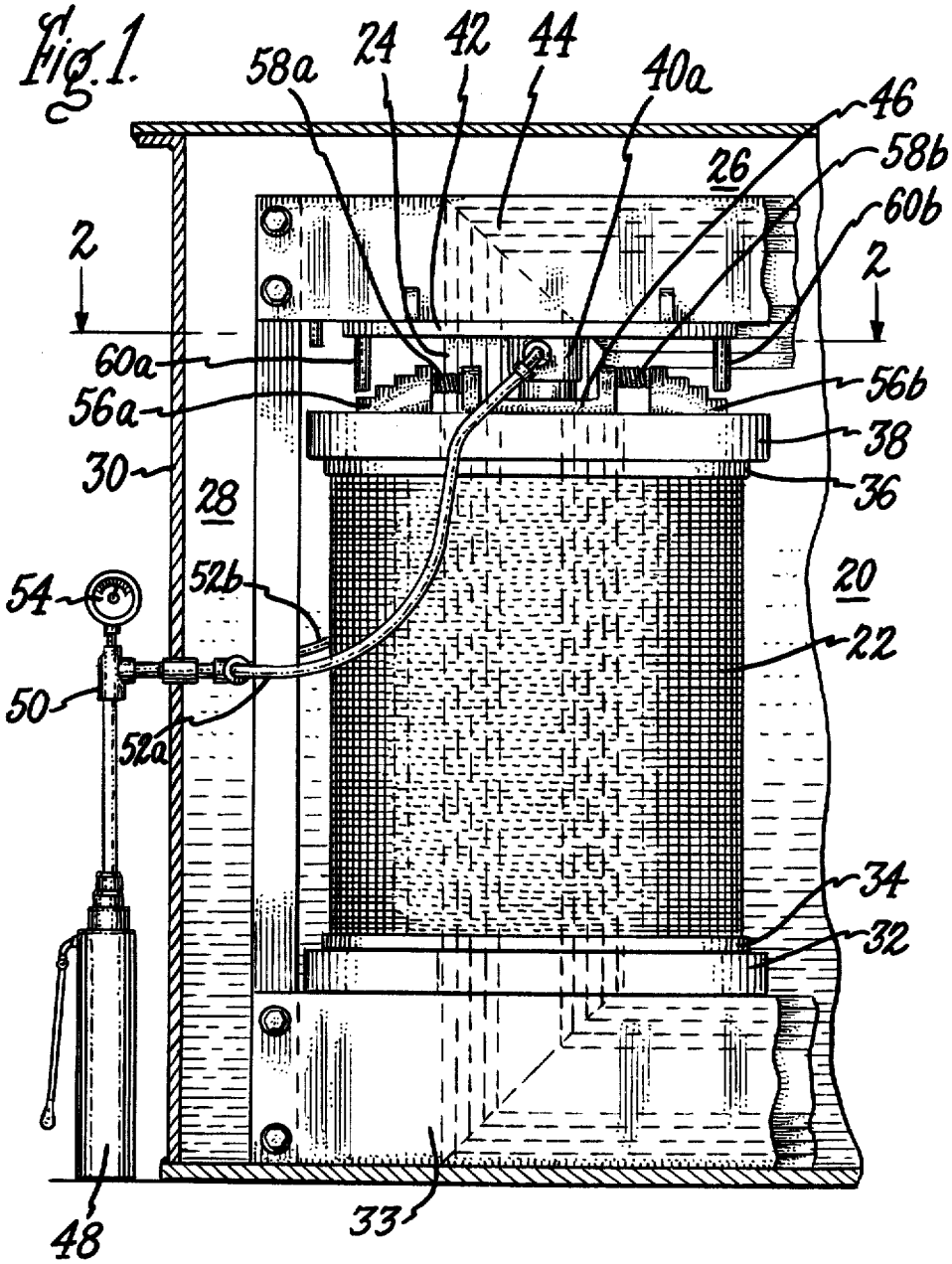
FIG. 1 is an elevational view, partly in section, of a transformer winding shown clamped to rigid core-clamping structure by the clamping device of the present invention.

Referring now to the drawings wherein like numerals are used to indicate like parts throughout, in FIG. 1, an elevational view, partly in section, of transformer 20 is illustrated. Transformer 20 includes hollow, cylindrical, layered winding 22 having leg 24 laminated magnetic core 26 extending through the hollow central portion of winding 22. Core-clamp 28, one function of which is to clamp the laminations of magnetic core 26 in a fixed position with respect to each other, is mounted in a fixed position with respect to transformer tank 30. Lower force-distributing plate 32, of washer-like shape, rests on lower clamping bar 33 of clamping structure 28 and leg 24 of magnetic core 26 extends through the hollow central portion of said lower force-distributing plate 32. Lower washer-like insulator 34 is interposed between winding 22 and lower force-distributing plate 32. Leg 24 of magnetic core 26 also extends through the opening in washer-like insulator 34. The purpose of washer-like insulator 34 is to reduce the chances of winding insulation breakdown when compressive forces are applied to winding 22 by lower force-distributing plate 32. Upper washer-like insulator 36 is positioned adjacent the upper end of winding 22 and leg 24 of magnetic core 26 extends through the opening in washer-like insulator 36. Upper force-distributing plate 38, of washer-like shape, is positioned adjacent the upper end of insulator 36 and leg 24 of magnetic core 26 extends through the opening in upper force-distribution plate 28 also. Hydraulic jack 40*a* is supported, at its upper end, by adapter plate 42; adapter plate 42 being fixedly attached to upper clamping bar 44. The lower end of hydraulic jack 40*a* is supported by spring support structure 46; spring support structure being fixedly attached to upper force-distributing plate 38. Upper clamping bar 44 and lower clamping bar 33 are mounted in a fixed position with respect to each other. Hydraulic jack 40*a* is manually actuated by hydraulic pump 48. Hydraulic fluid in hydraulic pump 48 is pumped through check valve 50 and then into hydraulic line 52*a* and 52*b*. The fluid that passes into hydraulic line 52*a* causes hydraulic jack 40*a* to expand which, in turn, results in a compression force being applied to winding 22. Hydraulic-fluid pressure gauge 54 indicates the amount of pressure being applied to hydraulic jack 40*a*. This hydraulic pressure is an indication of the amount of compressive force being applied to winding 22. Check valve 50 maintains the pressure being applied to hydraulic jack 40*a* at a level that is fairly near the maximum pressure applied to said hydraulic jack 40*a* if the integrity of the hydraulic system between check valve 50 and hydraulic jack 40*a* remains intact. A pair of stepped wedges 56*a* and 56*b*, slidably attached to the upper end of upper force-distributing plate 38, are forced laterally outward by spring 58*a* and 58*b*, the vertical faces of the steps of stepped wedges 56*a* and 56*b* moving into butting engagement with pins 60*a* and 60*b* respectively; pins 60*a* and 60*b* being fixedly attached to adapter plate 42. When a compressive force is applied to winding 22 by hydraulic jack 40a through upper force-distributing plate 38, said upper force-distributing plate and stepped wedges 56*a* and 56*b*, which are slidably attached to said upper force-distributing plate 38, move away from upper clamping bar 44, adapted plate 42 and pins 60*a* and 60*b*. When sufficient movement of these just mentioned members takes place, steps of stepped wedges 56*a* and 56*b* will be forced between pins 60*a* and 60*b* and upper force-distributing plate 38 respectively. With the foregoing arrangement, a relaxation in hydraulic pressure by jack 40*a* will have a negligible impact on the level of compressive force remaining on transformer winding 22. Any movement of upper force-distributing plate 38 towards upper clamping bar 44 will be limited by the engagement of pins 60*a* and 60*b* with their associated slidably mounted wedges 56*a* and 56*b*.

In order to obtain a more even distribution of the compressive force applied to transformer winding 22, an additional hydraulic jack and associated spring-loaded, motion limiting wedges are provided. These additional devices can be seen by referring to FIG. 2 which is a cross-sectional view, partly in section, taken along the line 2—2 in FIG. 1. Additional hydraulic jack 40*b*, diametrically across from hydraulic jack 40*a* on transformer winding 22 (FIG. 1), is mounted in the same manner as hydraulic jack 40*a*. Fluid from hydraulic pump 48 is forced through hydraulic line 52*b* as well as hydraulic line 52*a* as previously decribed resulting in a relatively uniform compressive force being applied to transformer winding 22 by hydraulic jacks 40*a* and 40*b*. Spring-loaded stepped wedges 62*a* and 62*b* and their associated pins 64a and 64*b* function in the same manner as previously described for stepped wedges 56*a* and 56*b* and their associated pins 60*a* and 60*b*.

Figure 2:
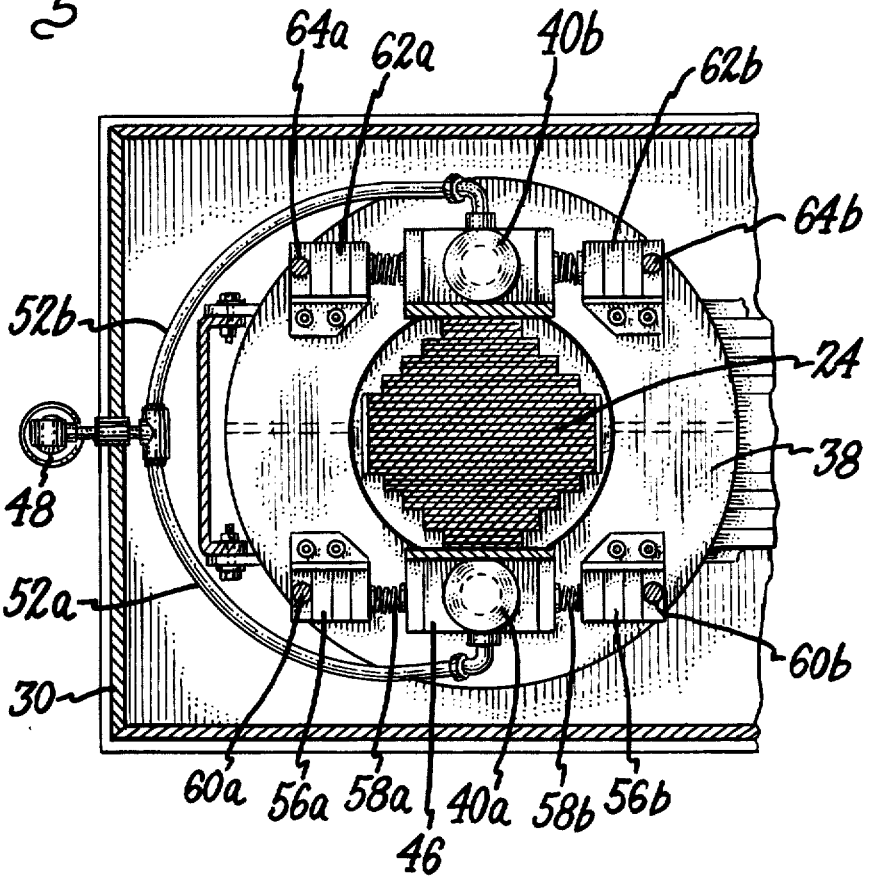
FIG. 2 is a cross-sectional view taken along the line 2—2 of FIG. 1.

Spring-loaded stepped wedges described in FIGS. 1 and 2 are merely one kind of transformer winding translatory motion limiting device. An alternative for the spring-loaded stepped wedges illustrated in FIGS. 1 and 2, in the form of a spring-loaded cam roller, is illustrated in FIG. 3.

Figure 3:
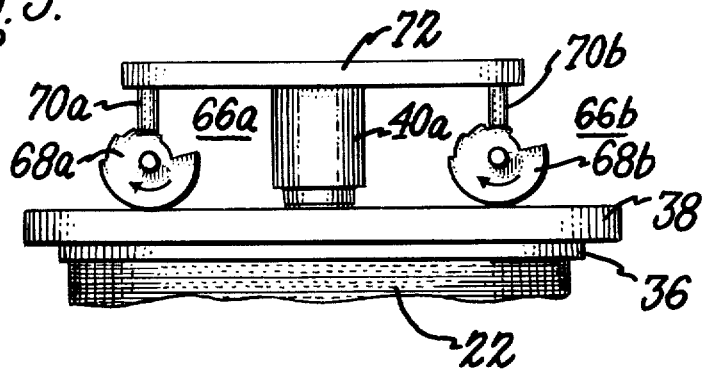
FIG. 3 is an elevational detail of an embodiment of the spring-loaded follow-up portion of the present invention in the form of a cam roller.

Referring now to FIG. 3, which is a front elevational detail of another embodiment of the mechanical follow-up portion of the present invention in the form of spring-loaded cam roller assemblies 66*a* and 66*b*. Cams 68*a* and 68*b*, having teetch located progressively radially outward from the center of cam rotation, are rotatably mounted to upper force-distributing plate 38. Torsional springs (not shown) apply a torsional force to cam 68*a* and 68*b*. However, said cams are unable to rotate due to engagement of the teeth of these cams with pins 70*a* and 70*b* respectively. Pins 70*a* and 70*b* are fixedly attached to adapter plate 72 which is, in turn, fixedly attached to upper clamping bar 44 (FIG. 1). With an increase in the compressive force on transformer winding 22 by hydraulic jack 40*a*, force-distributing plate 38 and cams 68*a* and 68*b* move away from pins 70*a* and 70*b* causing pins 70*a* and 70*b* to move to more outwardly positioned teeth of said cams 68*a* and 68*b* as cams 68*a* and 68*b* rotate under the influence of the previously mentioned torsional force. If the compressive force applied by hydraulic jack 40*a* is removed, the level of compressive force already applied will be maintained at some minimum level by the engagement of cams 68*a* and 68*b* with their associated pins 70*a* and 70*b*.

Figure 4:
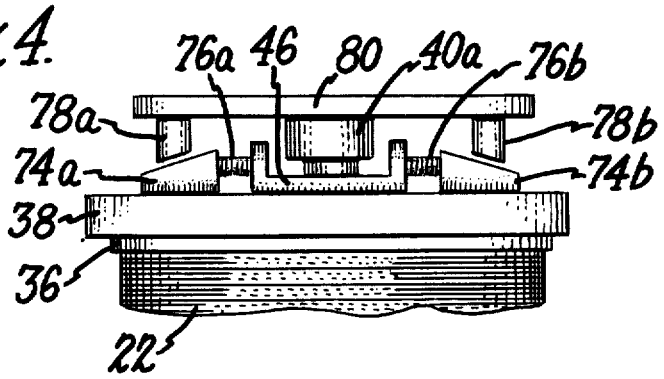
FIG. 4 is an elevational detail of an embodiment of the spring-loaded mechanical follow-up portion of the present invention in the form of a taper pin.

Another mechanical follow-up device, of the type previously described herein, is depicted in FIG. 4. Referring now to FIG. 4, which is a front elevational detail of another embodiment of the mechanical follow-up portion of the present invention in the form of spring-loaded taper pins 74*a* and 74*b*. Taper pins 74*a* and 74*b* are slidably attached to the upper end of upper force-distributing plate 38 and springs 76*a* and 76*b*, fixedly attached at one end to spring support structure 46, apply a radial force to said taper pins 74*a* and 74*b*; said spring support structure being fixedly attached to the upper surface of upper force-distributing plate 38. Radial movement of taper pins 74*a* and 74*b* is limited by the engagement of said taper pins 74*a* and 74*b* with tapered pins 78*a* and 78*b*. Tapered pins 78*a* and 78*b* are fixedly attached to adapter plate 80 which, in turn, is fixedly attached to upper clamping bar 44 (FIG. 1). With an increase in the compressive force applied to transformer winding 22 by hydraulic jack 40*a*, upper force-distributing plate 38 and taper pins 74*a* and 74*b* move away from tapered pins 78*a* and 78*b* respectively, causing taper pins 74*a* and 74*b* to move to a more radially outward position. If the compressive force applied by hydraulic jack 40*a* is removed, the level of compressive force already applied to transformer winding 22 will be maintained at some minimum level by the engagement of taper pins 74*a* and 74*b* with tapered pins 78*a* and 78*b* respectively.

Figure 5:
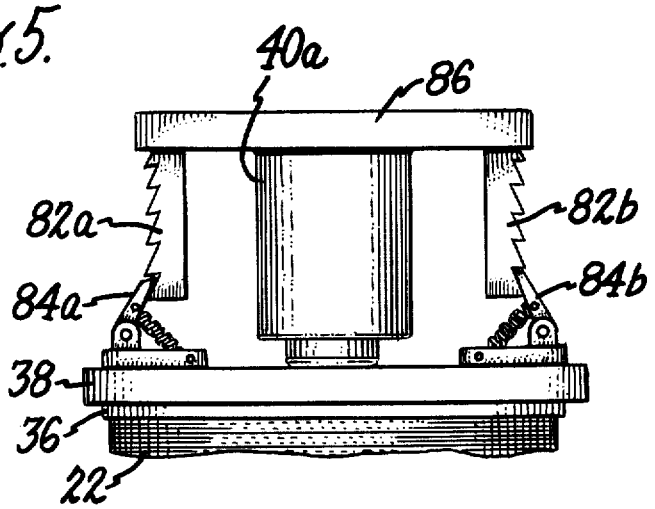
FIG. 5 is an elevational detail of an embodiment of the spring-loaded mechanical follow-up portion of the present invention in the form of a ratchet.

An additional mechanical follow-up device, of the type previously described herein, is depicted in FIG. 5. Referring now to FIG. 5, which is a front elevational detail of another embodiment of the mechanical follow-up portion of the present invention in the form of ratches 82*a* and 82*b* and their associated, rotatably mounted, spring-loaded pawls 84*a* and 84*b*. Pawls 84*a* and 84*b* are pivotally mounted and spring-loaded to upper force-distributing plate 38. Ratches 82a and 82b are fixedly attached to adapter plate 86 which, in turn, is fixedly attached to upper clamping bar 44 (FIG. 1). With an increase in the compressive force applied to transformer winding 22 by hydraulic jack 40*a*, spring-loaded pawls 84*a* and 84*b* move towards the free end of ratches 82*a* and 84*b* and eventually into more outwardly positioned notches in said ratches 82*a* and 82*b*. If the compressive force applied by hydraulic jack 40*a* is removed, the level of compressive force already applied will be maintained at some minimum level by the engagement of ratches 82*a* and 82*b* with cooperatively mounted, spring-loaded pawls 84*a* and 84*b* respectively.

DISCUSSION

In the preferred embodiment described herein, a clamping force is applied to a transformer winding by two hydraulically actuated jacks positioned diametrically across from one another on a rigid, force-distributing clamping ring having a washer-like shape. The number of force generating means and the placement of same is purely a matter of design choice. The present invention has application to clamping devices having any number of force-generating means.

Force used to clamp the transformer winding described herein has been limited to a hydraulically actuated jack. However, the mechanical follow-up devices described herein, and other equivalent devices, are equally applicable to force generating means that are other than hydraulically actuated, such as pneumatic, screw, etc., force generating means. In addition, spring-loaded follow-up devices, for use with transformer winding clamping apparatus, have been described. The mechanisms that have been described herein are merely illustrative and should not be considered as a complete list of all such mechanisms. Spring-loaded follow-up devices that incorporates wedges, gears, etc., are but a few of such mechanisms capable of incorporating the mechanical follow-up features of the present invention.

It will be apparent to those skilled in the art from the foregoing description of my invention that various improvements and modifications can be made in it without departing from the true scope of the invention. Accordingly, it is my intention to encompass within the scope of the appended claims the true limits and scope of my invention.

I claim:

1. In electrical apparatus of the type that is completely enclosed and mounted in a fixed relation with respect to said enclosure, having, a magnetic core, said core having at least one leg, winding structure, having a longitudinal axis, being disposed around said leg, said winding structure having first and second axial ends, a rigid core-clamping frame mounted adjacent to and in a fixed relation with respect to said core, a first force-distribution clamping plate positioned between one of said axial ends of said winding structure and said rigid core-clamping frame, a second force-distributing clamping plate positioned between the remaining axial end of said winding structure and said rigid clamping frame, a hydraulic actuator, actuated externally of said electrical apparatus enclosure, capable of causing a compressive force to be applied to said first and second force-distributing clamping plates, the force generated by said hydraulic actuator being reacted against said rigid core-clamping frame, the improvement which comprises:

means automatically maintaining said force-generated by said hydraulic actuator at some predetermined minimum value dependent upon the maximum force applied by said hydraulic actuator, once said hydraulic actuator relaxes said compressive force below a predetermined value.

2. Transformer winding clamping apparatus, as defined in claim 1, wherein the means for maintaining the force generated by said hydraulic actuator at a predetermined value comprises:

a. a spring-loaded stepped wedge slidably mounted to said first force-distributing clamping plate; and b. means fixedly mounting a pin to said rigid core-clamping frame for cooperative engagement with said slidably mounted stepped wedge to limit movement of said transformer winding with respect to said rigid core-clamping frame.

3. Transformer winding clamping apparatus, as defined in claim 1, wherein the means for maintaining the force-generated by said hydraulic actuator at a predetermined value comprises:

a. a spring-loaded cam roller rotatably mounted to said first force-generating clamping plate; and b. means fixedly mounting a pin to said rigid core-clamping frame for cooperative engagement with said cam roller to limit movement of said transformer winding with respect to said rigid core-clamping frame.

4. Transformer winding clamping apparatus, as defined in claim 1, wherein the means for maintaining the force generated by said hydraulic actuator at a predetermined value, comprises:

a. a spring-loaded taped pin slidably mounted to said first force-distributing clamping plate; and b. means fixedly mounting a tapered pin to said rigid core-clamping frame for cooperative engagement with said slidably mounted taper pin to limit movement of said transformer winding with respect to said rigid core-clamping frame.

5. Transformer winding clamping apparatus, as defined in claim 1, wherein the means for maintaining the force generated by said hydraulic actuator at a predetermined value comprises:

a. means fixedly mounting a ratch to said rigid core-clamping frame; and b. a spring-loaded pawl, pivotally mounted to said first force-distributing clamping plate for ratcheting engagement with said ratch to limit movement of said transformer winding with respect to said rigid core-clamping frame.

6. In electrical apparatus of the type that is completely enclosed and mounted in a fixed relation with respect to said enclosure, having.

a magnetic core, said core having at least one leg, winding structure, having a longitudinal axis, being disposed around said leg, said winding structure having first and second axial ends, a rigid core-clamping frame mounted adjacent to and in a fixed relation with respect to said core, a first force-distributing clamping plate positioned between one of said axial ends of said winding structure and said rigid core-clamping frame, a second force-distributing clamping plate positioned between the remaining axial end of said winding structure and said rigid clamping frame, a pneumatic actuator, actuated externally of said electrical apparatus enclosure, capable of causing a compressive force to be applied to said first and second force-distributing clamping plates, the force generated by said pneumatic actuator being reacted against said rigid core-clamping frame, the improvement which comprises:

means automatically maintaining said force generated by said pneumatic actuator at some predetermined minimum value dependent upon the maximum force applied by said pneumatic actuator, once said pneumatic actuator relaxes said compressive force below a predetermined value.

7. Transformer winding clamping apparatus, as defined in claim 6, wherein the means for maintaining the force generated by said pneumatic actuator at a predetermined value comprises:

a. a spring-loaded stepped wedge slidably mounted to said first force-distributing clamping plate; and b. means fixedly mounting a pin to said rigid core-clamping frame for cooperative engagement with said slidably mounted stepped wedge to limit movement of said transformer winding with respect to said rigid core-clamping frame.

8. Transformer winding clamping apparatus, as defined in claim 6, wherein the means for maintaining the force-generated by pneumatic actuator at a predetermined value comprises:

a. a spring-loaded cam roller rotatably mounted to said first force-distributing clamping plate; and b. means fixedly mounting a pin to said rigid core-clamping frame for cooperative engagement with said cam roller to limit movement of said transformer winding with respect to said rigid core-clamping frame.

9. Transformer winding clamping apparatus, as defined in claim 6, wherein the means for maintaining the force generated by said pneumatic actuator at a predetermined value, comprises:

a. a spring-loaded taper pin slidably mounted to said first force-distributing clamping plate; and b. means fixedly mounting a tapered pin to said rigid core-clamping frame for cooperative engagement with said slidably mounted taper pin to to limit movement of said transformer winding with respect to said rigid core-clamping frame.

10. Transformer winding clamping apparatus, as defined in claim 6, wherein the means for maintaining the force generated by said pneumatic actuator at a predetermined value, comprises:

a. means fixedly mounting a ratch to said rigid core-clamping frame; and b. a spring-loaded pawl, pivotally mounted to said first force-distributing clamping plate for ratcheting engagement with said ratch to limit movement of said transformer winding with respect to said rigid core-clamping frame.

* * * * *